US011559149B2

(12) United States Patent
Groover et al.

(10) Patent No.: US 11,559,149 B2
(45) Date of Patent: Jan. 24, 2023

(54) METHOD AND APPARATUS FOR TRANSITIONING BETWEEN ROTARY DRILLING AND SLIDE DRILLING WHILE MAINTAINING A BIT OF A BOTTOM HOLE ASSEMBLY ON A WELLBORE BOTTOM

(71) Applicant: Nabors Drilling Technologies USA, Inc., Houston, TX (US)

(72) Inventors: Austin Groover, Spring, TX (US); Scott Coffey, Houston, TX (US); Drew Curran, Houston, TX (US); Adam Lacroix, Cypress, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 316 days.

(21) Appl. No.: 16/993,665

(22) Filed: Aug. 14, 2020

(65) Prior Publication Data

US 2022/0049593 A1 Feb. 17, 2022

(51) Int. Cl.

| | |
|---|---|
| ***A47F 7/14*** | (2006.01) |
| ***A47F 5/01*** | (2006.01) |
| ***E21B 3/00*** | (2006.01) |
| ***E21B 7/04*** | (2006.01) |
| ***E21B 44/00*** | (2006.01) |
| ***E21B 47/024*** | (2006.01) |

(52) U.S. Cl.
CPC ..... *A47F 7/145* (2013.01); *A47F 5/01* (2013.01); *E21B 3/00* (2013.01); *E21B 7/04* (2013.01); *E21B 44/00* (2013.01); *E21B 47/024* (2013.01)

(58) Field of Classification Search
CPC ... E21B 44/00; E21B 3/00; E21B 7/04; E21B 47/024; A47F 5/01; A47F 7/145
See application file for complete search history.

(56) References Cited

U.S. PATENT DOCUMENTS

2009/0078462 A1* 3/2009 Boone ..... E21B 7/04 175/73
2019/0301273 A1* 10/2019 Gillan ..... E21B 7/04

* cited by examiner

*Primary Examiner* — Dany E Akakpo
(74) *Attorney, Agent, or Firm* — Haynes and Boone, LLP

(57) ABSTRACT

A method of transitioning from rotary to slide drilling while maintaining a bit of a bottom hole assembly ("BHA") on a wellbore bottom includes (a) recording a first toolface value of the BHA that is coupled to a drill string; (b) identifying a correlation between the first toolface value and a first quill position of a quill coupled to the drill string; (c) identifying a breakover torque for the drill string; (d) performing rotary drilling; (e) recording a second toolface value while the bit remains on the wellbore bottom; (f) receiving, while the bit remains on the wellbore bottom, a target toolface value; (g) calculating, while the bit remains on the wellbore bottom, an unwind amount to unwind the drill string; and (h) unwinding the drill string by the unwind amount to bring the second toolface value closer to the target toolface value while the bit remains on the bottom.

12 Claims, 6 Drawing Sheets

METHOD AND APPARATUS FOR TRANSITIONING BETWEEN ROTARY DRILLING AND SLIDE DRILLING WHILE MAINTAINING A BIT OF A BOTTOM HOLE ASSEMBLY ON A WELLBORE BOTTOM

BACKGROUND

At the outset of a drilling operation, drillers typically establish a drilling plan that includes a target location and a drilling path, or well plan, to the target location. Once drilling commences, the bottom hole assembly ("BHA") is directed or "steered" from a vertical drilling path in any number of directions, to follow the proposed well plan. For example, to recover an underground hydrocarbon deposit, a well plan might include a vertical well to a point above the reservoir, then a directional or horizontal well that penetrates the deposit. The drilling operator may then steer the BHA, including the bit, through both the vertical and horizontal aspects in accordance with the plan.

Commonly, the transition between rotary and slide drilling involves the removal of the bit from the bottom of the well. The highest levels of shock and vibration, which are phenomena that cause damage to bit cutters and downhole equipment, occur while placing the bit on bottom or removing the bit from bottom. In addition to the high levels of shock and vibration, the process of transitioning between rotary and slide can be time consuming.

As such, there is a need for a rig automation system to better accomplish the transition between rotary and slide drilling, and vice versa, without removing the bit from bottom, which has the effect of minimizing downhole shock and vibrations, reducing downhole equipment failures, and reducing nonproductive time at the rig.

SUMMARY

A method of transitioning from rotary drilling to slide drilling while maintaining a bit of a bottom hole assembly on a wellbore bottom is disclosed. The method includes: (a) recording a first measured toolface value of the bottom hole assembly, wherein the bottom hole assembly is coupled to a drill string; (b) identifying a correlation between the first measured toolface value and a first quill position of a quill coupled to the drill string; (c) identifying a breakover torque for the drill string; (d) performing rotary drilling; (e) recording a second measured toolface value while the bit remains on the wellbore bottom; (f) receiving, while the bit remains on the wellbore bottom, a target toolface value; (g) calculating, while the bit remains on the wellbore bottom, an unwind amount to unwind the drill string; and (h) unwinding the drill string by the unwind amount to bring the second measured toolface value closer to the target toolface value while the bit remains on the wellbore bottom. In one embodiment, each of the second measured toolface value, the unwind amount, and the target toolface value is expressed in degrees; wherein calculating the unwind amount includes: calculating a clockwise radial distance expressed in degrees between the second measured toolface value and the target toolface value; and subtracting the clockwise radial distance from the breakover torque to determine the unwind amount. In one embodiment, when the second measured toolface value is greater than the target toolface value, then the clockwise radial distance is a difference—of 360 degrees and the second measured toolface value—added to the target toolface value. In one embodiment, when the target toolface value is greater than the second measured toolface value, then the clockwise radial distance is the difference between the target toolface value and the second measured toolface value. In one embodiment, the method also includes increasing a weight on bit ("WOB") after unwinding the drill string; and beginning slide drilling. In one embodiment, the drill string is not rotating when the first measured toolface value is recorded; and wherein identifying the correlation between the first measured toolface value and the first quill position includes referencing rotation of the drill string relative to the first quill position. In one embodiment, identifying the breakover torque for the drill string includes: capturing a torque measurement while increasing a rotations per minute ("RPM") of the drill string; and recording a number of revolutions required to reach maximum off-bottom rotating torque as the breakover torque. In one embodiment, performing rotary drilling includes rotary drilling at a WOB indicator setpoint and a flow rate setpoint; and wherein the method further includes, after performing rotary drilling and before the second measured toolface value is recorded, reducing an RPM of the drill string to zero while maintaining the WOB indicator at the WOB indicator setpoint and the flow rate at the flow rate setpoint. In one embodiment, the following steps (a)-(c) occur during an operation to add a stand of pipe to the drill string, and wherein the operation to add the stand of pipe occurs prior to the beginning of the slide drilling.

A method of transitioning from slide drilling to rotary drilling while maintaining a bit on a wellbore bottom is disclosed. The method includes: (a) identifying an off-bottom rotating hook load; (b) lowering the bit to the wellbore bottom; (c) performing slide drilling at a first hook load while the bit remains on the wellbore bottom; (d) reducing the first hook load to a target hook load while the bit remains on the wellbore bottom; (e) rotating drill string at an introductory RPM while the bit remains on the wellbore bottom; (f) lowering drill string to reach an introductory WOB while the bit remains on the wellbore bottom; and (g) performing rotary drilling at introductory WOB and introductory RPM while the bit remains on the wellbore bottom. In one embodiment, identifying the off-bottom rotating hook load occurs prior to slide drilling. In one embodiment, the target hook load is a percentage of the off-bottom rotating hook load. In one embodiment, the method also includes, after the step (g): incrementally increasing the WOB until a target rotary drilling WOB setpoint is reached; and incrementally increasing the RPM until a target rotary drilling RPM setpoint is reached. In one embodiment, the method also includes, simultaneously with step (e), adjusting a flow rate towards a target rotary drilling flow rate. In one embodiment, the following steps (a)-(c) occur during an operation to add a stand of pipe to the drill string, and wherein the operation to add the stand of pipe occurs prior to beginning the slide drilling.

An apparatus adapted to transition a bit of a bottom hole assembly from a rotary drilling operation to a slide drilling operation while maintaining the bit on a wellbore bottom is disclosed. The apparatus includes: a non-transitory computer readable medium having stored thereon a plurality of instructions, wherein the instructions are executed with at least one processor so that the following steps are executed: (a) recording a first measured toolface value of the bottom hole assembly, wherein the bottom hole assembly is coupled to a drill string; (b) identifying a correlation between the first measured toolface value and a first quill position of a quill coupled to the drill string; (c) identifying a breakover torque for the drill string; (d) performing rotary drilling; (e) recording a second measured toolface value while the bit remains on the wellbore bottom; (f) receiving, while the bit remains on the wellbore bottom, a target toolface value; (g) calculating, while the bit remains on the wellbore bottom, an unwind amount to unwind the drill string; and (h) unwinding the drill string by the unwind amount to bring the second measured toolface value closer to the target toolface value while the bit remains on the wellbore bottom. In one embodiment, each of the second measured toolface value, the unwind amount, and the target toolface value is expressed in degrees; wherein calculating the unwind amount includes: calculating a clockwise radial distance expressed in degrees between the second measured toolface value and the target toolface value; and subtracting the clockwise radial distance from the breakover torque to determine the unwind amount. In one embodiment, when the second measured toolface value is greater than the target toolface value, then the clockwise radial distance is a difference—of 360 degrees and the second measured toolface value—added to the target toolface value. In one embodiment, when the target toolface value is greater than the second measured toolface value, then the clockwise radial distance is the difference between the target toolface value and the second measured toolface value. In one embodiment, the instructions are executed with the at least one processor so that the following additional steps are executed: increasing a weight on bit ("WOB") after unwinding the drill string; and beginning slide drilling.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
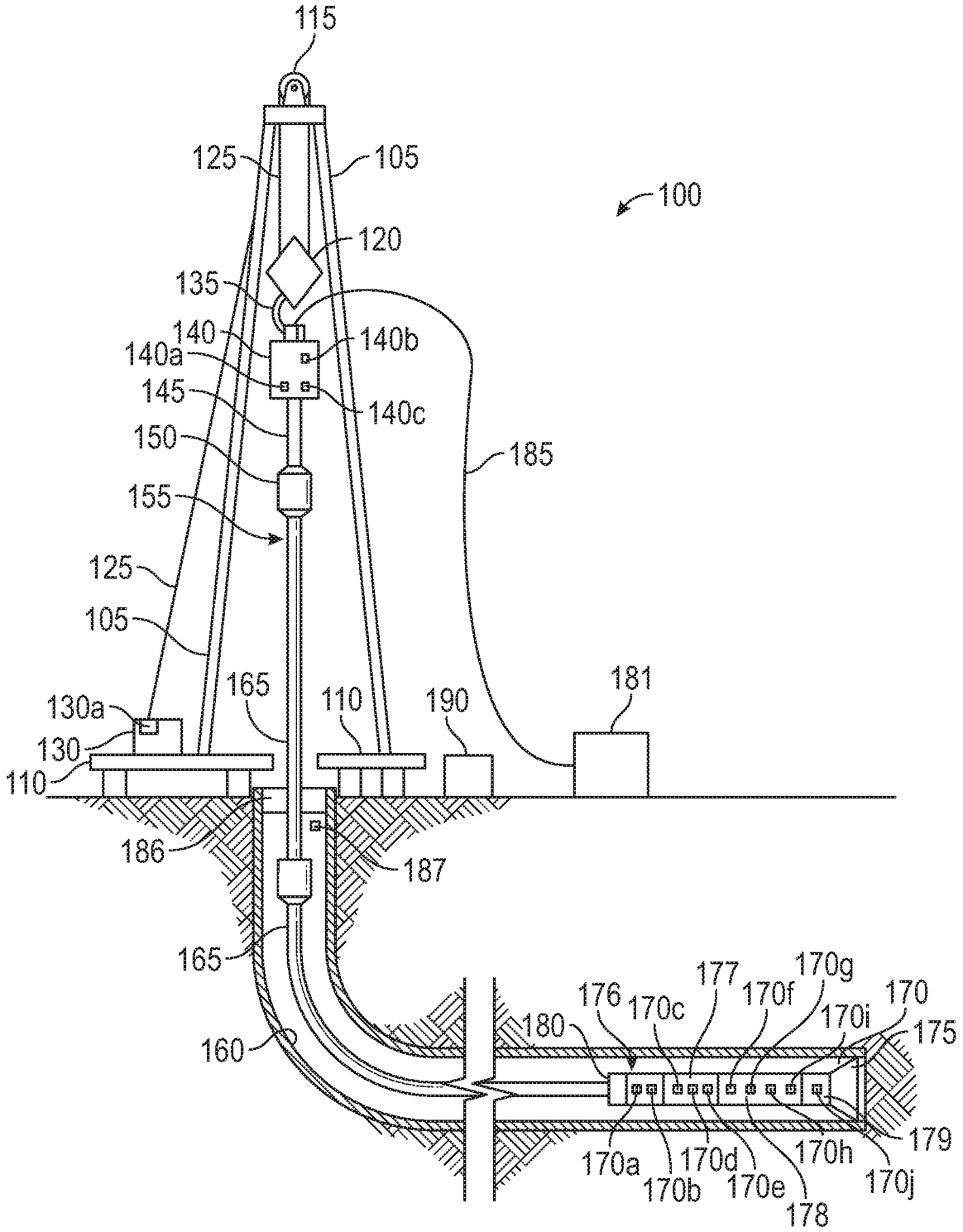
FIG. 1 is a schematic diagram of a drilling rig apparatus according to one or more aspects of the present disclosure.

It is to be understood that the present disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact and may also include embodiments in which additional features may be formed interposing the first and second features, such that the first and second features may not be in direct contact.

The apparatus and methods disclosed herein automate the alteration and execution of drilling instructions using data received from offset drilling rigs, resulting in increased efficiency and speed during drilling compared to conventional systems that do not consider real-time data from offset drilling rigs. Prior to drilling, a target location is typically identified, and an optimal wellbore profile or planned path is established. Such target well plans are generally based upon the most efficient or effective path to the target location or locations and are based on the data available at the time. As drilling proceeds, the apparatus and methods disclosed herein determine the position of the BHA, receive real-time data from offset drilling rigs, create instructions based on the position of the BHA and the real-time data from the offset drilling rigs, and execute the instructions. Thus, the apparatus and methods disclosed herein automate the receipt of data from a network of offset drilling rigs and modification of drilling instructions based on the data from the network of offset drilling rigs. Generally, real-time data includes data received via a standard static survey, continuous data received from a BHA between two consecutive standard static surveys, and data associated with the drilling operations before, during, and after drilling.

Referring to FIG. 1, illustrated is a schematic view of an apparatus 100 demonstrating one or more aspects of the present disclosure. The apparatus 100 is or includes a land-based drilling rig. However, one or more aspects of the present disclosure are applicable or readily adaptable to any type of drilling rig, such as jack-up rigs, semisubmersibles, drill ships, coil tubing rigs, well service rigs adapted for drilling and/or re-entry operations, and casing drilling rigs, among others within the scope of the present disclosure.

Generally, the apparatus 100 monitors, in real-time, drilling operations relating to a wellbore, receives data in real-time or close to real-time from a network of offset drilling rigs, and creates and/or modifies drilling instructions based on the real-time data. As used herein, the term "real-time" is thus meant to encompass close to real-time, such as within about 10 seconds, preferably within about 5 seconds, and more preferably within about 2 seconds. "Real-time" can also encompass an amount of time that provides data based on a wellbore drilled to a given depth to provide actionable data according to the present invention before a further wellbore being drilled achieves that depth. In some embodiments, the apparatus 100 recommends options to correct deviations from a planned well program for the wellbore and interprets drilling data while referencing the data from the network of offset drilling rigs to avoid drilling events similar to those encountered in the network of offset drilling rigs.

Apparatus 100 includes a mast 105 supporting lifting gear above a rig floor 110. The lifting gear includes a crown block 115 and a traveling block 120. The crown block 115 is coupled at or near the top of the mast 105, and the traveling block 120 hangs from the crown block 115 by a drilling line 125. One end of the drilling line 125 extends from the lifting gear to draw works 130, which is configured to reel out and reel in the drilling line 125 to cause the traveling block 120 to be lowered and raised relative to the rig floor 110. The draw works 130 may include a rate of penetration ("ROP") sensor 130*a*, which is configured for detecting an ROP value or range, and a controller to feed-out and/or feed-in of a drilling line 125. The other end of the drilling line 125, known as a dead line anchor, is anchored to a fixed position, possibly near the draw works 130 or elsewhere on the rig.

A hook 135 is attached to the bottom of the traveling block 120. A top drive 140 is suspended from the hook 135. A quill 145, extending from the top drive 140, is attached to a saver sub 150, which is attached to a drill string 155 suspended within a wellbore 160. Alternatively, the quill 145 may be attached to the drill string 155 directly.

The term "quill" as used herein is not limited to a component which directly extends from the top drive 140, or which is otherwise conventionally referred to as a quill. For example, within the scope of the present disclosure, the "quill" may additionally or alternatively include a main shaft, a drive shaft, an output shaft, and/or another component which transfers torque, position, and/or rotation from the top drive or other rotary driving element to the drill string, at least indirectly. Nonetheless, albeit merely for the sake of clarity and conciseness, these components may be collectively referred to herein as the "quill."

The drill string 155 includes interconnected sections of drill pipe 165 and a BHA 170, which includes a drill bit 175. The BHA 170 may include one or more measurement-while-drilling ("MWD") or wireline conveyed instruments 176, flexible connections 177, optional motors 178, adjustment mechanisms 179 for push-the-bit drilling or bent housing and bent subs for point-the-bit drilling, a controller 180, stabilizers, and/or drill collars, among other components. One or more pumps 181 may deliver drilling fluid to the drill string 155 through a hose or other conduit 185, which may be connected to the top drive 140.

The downhole MWD or wireline conveyed instruments 176 may be configured for the evaluation of physical properties such as pressure, temperature, torque, weight-on-bit ("WOB"), vibration, inclination, azimuth, toolface orientation in three-dimensional space, and/or other downhole parameters. These measurements may be made downhole, stored in solid-state memory for some time, sent to the controller 180, and downloaded from the instrument(s) at the surface and/or transmitted real-time to the surface. Data transmission methods may include, for example, digitally encoding data and transmitting the encoded data to the surface, possibly as pressure pulses in the drilling fluid or mud system, acoustic transmission through the drill string 155, electronic transmission through a wireline or wired pipe, and/or transmission as electromagnetic pulses. The MWD tools and/or other portions of the BHA 170 may have the ability to store measurements for later retrieval via wireline and/or when the BHA 170 is tripped out of the wellbore 160.

In an example embodiment, the apparatus 100 may also include a rotating blow-out preventer ("BOP") 186, such as if the wellbore 160 is being drilled utilizing under-balanced or managed-pressure drilling methods. In such embodiment, the annulus mud and cuttings may be pressurized at the surface, with the actual desired flow and pressure possibly being controlled by a choke system, and the fluid and pressure being retained at the well head and directed down the flow line to the choke by the rotating BOP 186. The apparatus 100 may also include a surface casing annular pressure sensor 187 configured to detect the pressure in the annulus defined between, for example, the wellbore 160 (or casing therein) and the drill string 155. It is noted that the meaning of the word "detecting," in the context of the present disclosure, may include detecting, sensing, measuring, calculating, and/or otherwise obtaining data. Similarly, the meaning of the word "detect" in the context of the present disclosure may include detect, sense, measure, calculate, and/or otherwise obtain data.

In the example embodiment depicted in FIG. 1, the top drive 140 is utilized to impart rotary motion to the drill string 155. However, aspects of the present disclosure are also applicable or readily adaptable to implementations utilizing other drive systems, such as a power swivel, a rotary table, a coiled tubing unit, a downhole motor, and/or a conventional rotary rig, among others.

The apparatus 100 may include a downhole annular pressure sensor **170*a* coupled to or otherwise associated with the BHA 170. The downhole annular pressure sensor 170*a* may be configured to detect a pressure value or range in the annulus-shaped region defined between the external surface of the BHA 170 and the internal diameter of the wellbore 160**, which may also be referred to as the casing pressure, downhole casing pressure, MWD casing pressure, or downhole annular pressure. These measurements may include both static annular pressure (pumps off) and active annular pressure (pumps on).

The apparatus 100 may additionally or alternatively include a shock/vibration sensor **170*b* that is configured for detecting shock and/or vibration in the BHA 170. The apparatus 100 may additionally or alternatively include a mud motor delta pressure (AP) sensor 170*c* that is configured to detect a pressure differential value or range across the one or more optional motors 178 of the BHA 170. In some embodiments, the mud motor $\Delta P$ may be alternatively or additionally calculated, detected, or otherwise determined at the surface, such as by calculating the difference between the surface standpipe pressure just off-bottom and pressure once the bit touches bottom and starts drilling and experiencing torque. The one or more motors 178 may each be or include a positive displacement drilling motor that uses hydraulic power of the drilling fluid to drive the bit 175, also known as a mud motor. One or more torque sensors, such as a bit torque sensor, may also be included in the BHA 170 for sending data to a controller 190 that is indicative of the torque applied to the bit 175**.

The apparatus 100 may additionally or alternatively include a toolface sensor **170*e* configured to estimate or detect the current toolface orientation or toolface angle. The toolface sensor 170*c* may be or include a conventional or future-developed gravity toolface sensor which detects toolface orientation relative to the Earth's gravitational field. Alternatively, or additionally, the toolface sensor 170*c* may be or include a conventional or future-developed magnetic toolface sensor which detects toolface orientation relative to magnetic north or true north. In an example embodiment, a magnetic toolface sensor may detect the current toolface when the end of the wellbore is less than about 7° from vertical, and a gravity toolface sensor may detect the current toolface when the end of the wellbore is greater than about 7° from vertical. However, other toolface sensors may also be utilized within the scope of the present disclosure, including non-magnetic toolface sensors and non-gravitational inclination sensors. The toolface sensor 170*c* may also, or alternatively, be or include a conventional or future-developed gyro sensor. The apparatus 100 may additionally or alternatively include a WOB sensor 170*f* integral to the BHA 170 and configured to detect WOB at or near the BHA 170. The apparatus 100 may additionally or alternatively include an inclination sensor 170*g* integral to the BHA 170 and configured to detect inclination at or near the BHA 170. The apparatus 100 may additionally or alternatively include an azimuth sensor 170*h* integral to the BHA 170 and configured to detect azimuth at or near the BHA 170. The apparatus 100 may additionally or alternatively include a torque sensor 140***a* coupled to or otherwise associated with the top drive 140. The torque sensor 140*a* may alternatively be located in or associated with the BHA 170. The torque sensor 140*a* may be configured to detect a value or range of the torsion of the quill 145 and/or the drill string 155 (e.g., in response to operational forces acting on the drill string). The top drive 140 may additionally or alternatively include or otherwise be associated with a speed sensor 140*b* configured to detect a value or range of the rotational speed of the quill 145. In some embodiments, the BHA 170 also includes another directional sensor 170*i* (e.g., azimuth, inclination, toolface, combination thereof, etc.) that is spaced along the BHA 170 from a first directional sensor (e.g., the inclination sensor 170*g*, the azimuth sensor 170*h*). For example, and in some embodiments, the sensor 170*i* is positioned in the MWD 176 and the first directional sensor is positioned in the adjustment mechanism 179, with a known distance between them, for example 20 feet, configured to estimate or detect the current toolface orientation or toolface angle. The sensors 170*a*-170*j* are not limited to the arrangement illustrated in FIG. 1 and may be spaced along the BHA 170 in a variety of configurations.

The top drive 140, the draw works 130, the crown block 115, the traveling block 120, drilling line or dead line anchor may additionally or alternatively include or otherwise be associated with a WOB or hook load sensor 140*c* (WOB calculated from the hook load sensor that can be based on active and static hook load) (e.g., one or more sensors installed somewhere in the load path mechanisms to detect and calculate WOB, which can vary from rig-to-rig) different from the WOB sensor 170*f*. The WOB sensor 140*f* may be configured to detect a WOB value or range, where such detection may be performed at the top drive 140, the draw works 130, or other component of the apparatus 100. Generally, the hook load sensor 140*c* detects the load on the hook 135 as it suspends the top drive 140 and the drill string 155.

The detection performed by the sensors described herein may be performed once, continuously, periodically, and/or at random intervals. The detection may be manually triggered by an operator or other person accessing a human-machine interface ("HMI") or GUI, or automatically triggered by, for example, a triggering characteristic or parameter satisfying a predetermined condition (e.g., expiration of a time period, drilling progress reaching a predetermined depth, drill bit usage reaching a predetermined amount, etc.). Such sensors and/or other detection means may include one or more interfaces which may be local at the well/rig site or located at another, remote location with a network link to the system.

In some embodiments, the controller 180 is configured to control or assist in the control of one or more components of the apparatus 100. For example, the controller 180 may be configured to transmit operational control signals to the controller 190, the draw works 130, the top drive 140, other components of the BHA 170 such as the adjustment mechanism 179, and/or the pump 181. The controller 180 may be a stand-alone component that forms a portion of the BHA 170 or be integrated in the adjustment mechanism 179 or another sensor that forms a portion of the BHA 170. The controller 180 may be configured to transmit the operational control signals or instructions to the draw works 130, the top drive 140, other components of the BHA 170, and/or the pump 181 via wired or wireless transmission means which, for the sake of clarity, are not depicted in FIG. 1.

The apparatus 100 also includes the controller 190, which is or forms a portion of a computing system, configured to control or assist in the control of one or more components of the apparatus 100. For example, the controller 190 may be configured to transmit operational control signals to the draw works 130, the top drive 140, the BHA 170 and/or the pump 181. The controller 190 may be a stand-alone component installed near the mast 105 and/or other components of the apparatus 100. In an example embodiment, the controller 190 includes one or more systems located in a control room proximate the mast 105, such as the general-purpose shelter often referred to as the "doghouse" serving as a combination tool shed, office, communications center, and general meeting place. The controller 190 may be configured to transmit the operational control signals to the draw works 130, the top drive 140, the BHA 170, and/or the pump 181 via wired or wireless transmission means which, for the sake of clarity, are not depicted in FIG. 1.

In some embodiments, the controller 190 is not operably coupled to the top drive 140, but instead may include other drive systems, such as a power swivel, a rotary table, a coiled tubing unit, a downhole motor, and/or a conventional rotary rig, among others.

In some embodiments, the controller 190 controls the flow rate and/or pressure of the output of the mud pump 181.

In some embodiments, the controller 190 controls the feed-out and/or feed-in of the drilling line 125, rotational control of the draw works (in v. out) to control the height or position of the hook 135 and may also control the rate the hook 135 ascends or descends. However, example embodiments within the scope of the present disclosure include those in which the draw-works-drill-string-feed-off system may alternatively be a hydraulic ram or rack and pinion type hoisting system rig, where the movement of the drill string 155 up and down is via something other than the draw works 130. The drill string 155 may also take the form of coiled tubing, in which case the movement of the drill string 155 in and out of the hole is controlled by an injector head which grips and pushes/pulls the tubing in/out of the hole. Nonetheless, such embodiments may still include a version of the draw works controller, which may still be configured to control feed-out and/or feed-in of the drill string 155.

Generally, the apparatus 100 also includes a hook position sensor that is configured to detect the vertical position of the hook 135, the top drive 140, and/or the travelling block 120. The hook position sensor may be coupled to, or be included in, the top drive 140, the draw works 130, the crown block 115, and/or the traveling block 120 (e.g., one or more sensors installed somewhere in the load path mechanisms to detect and calculate the vertical position of the top drive 140, the travelling block 120, and the hook 135, which can vary from rig-to-rig). The hook position sensor is configured to detect the vertical distance the drill string 155 is raised and lowered, relative to the crown block 115. In some embodiments, the hook position sensor is a draw works encoder, which may be the ROP sensor 130*a*. In some embodiments, the apparatus 100 also includes a rotary RPM sensor that is configured to detect the rotary RPM of the drill string 155. This may be measured at the top drive 140 or elsewhere, such as at surface portion of the drill string 155. In some embodiments, the apparatus 100 also includes a quill position sensor that is configured to detect a value or range of the rotational position of the quill 145, such as relative to true north or another stationary reference. In some embodiments, the apparatus 100 also includes a pump pressure sensor that is configured to detect the pressure of mud or fluid that powers the BHA 170 at the surface or near the surface. In some embodiments, the apparatus also includes a MSE sensor that is configured to detect the MSE representing the amount of energy required per unit volume of drilled rock. In some embodiments, the MSE is not directly sensed, but is calculated based on sensed data at the controller 190 or other controller. In some embodiments, the apparatus 100 also includes a bit depth sensor that detects the depth of the bit 175.

Figure 2:
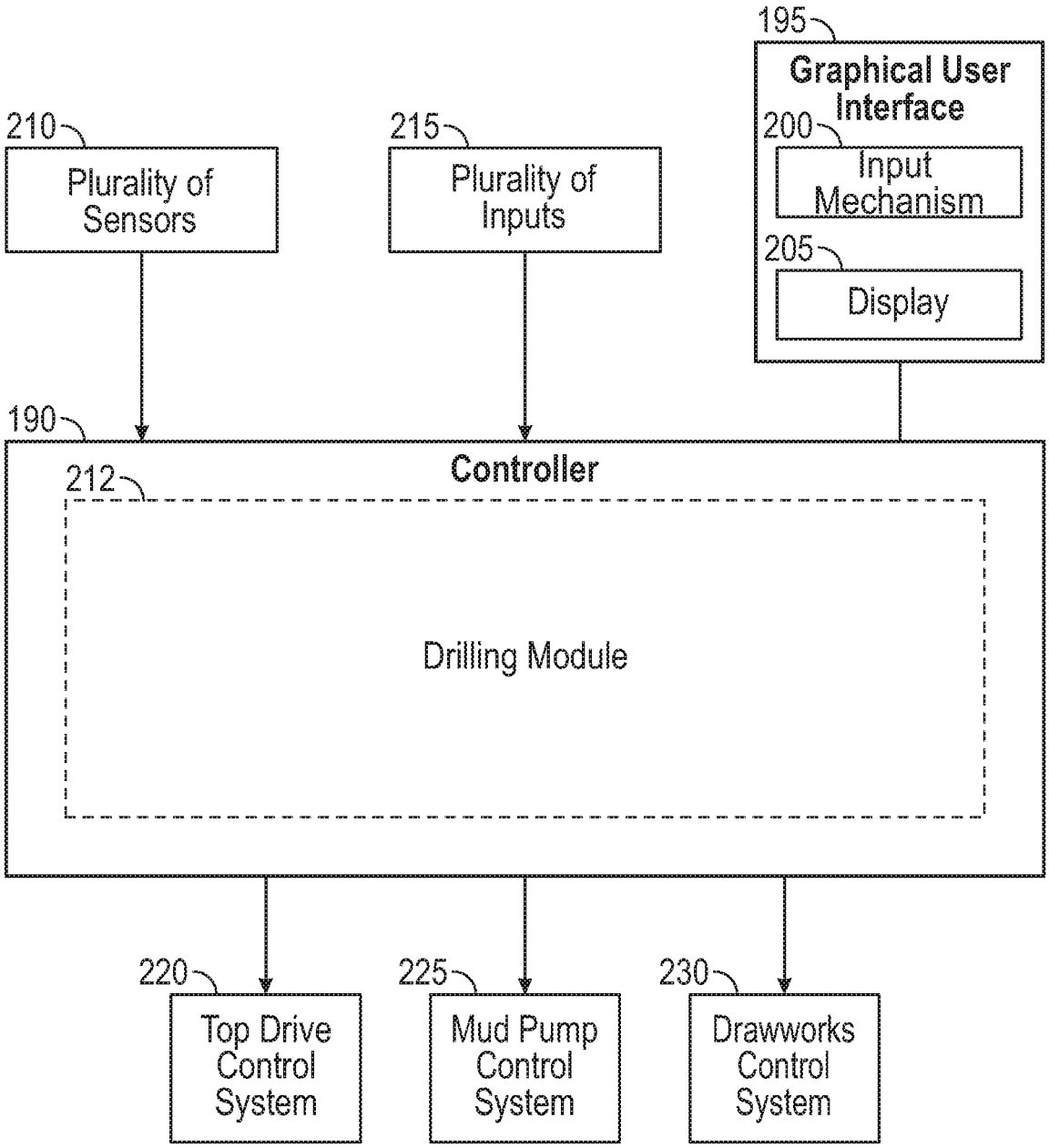
FIG. 2 is a schematic illustration of a portion of the apparatus of FIG. 1, according to one or more aspects of the present disclosure.
Figure 3:
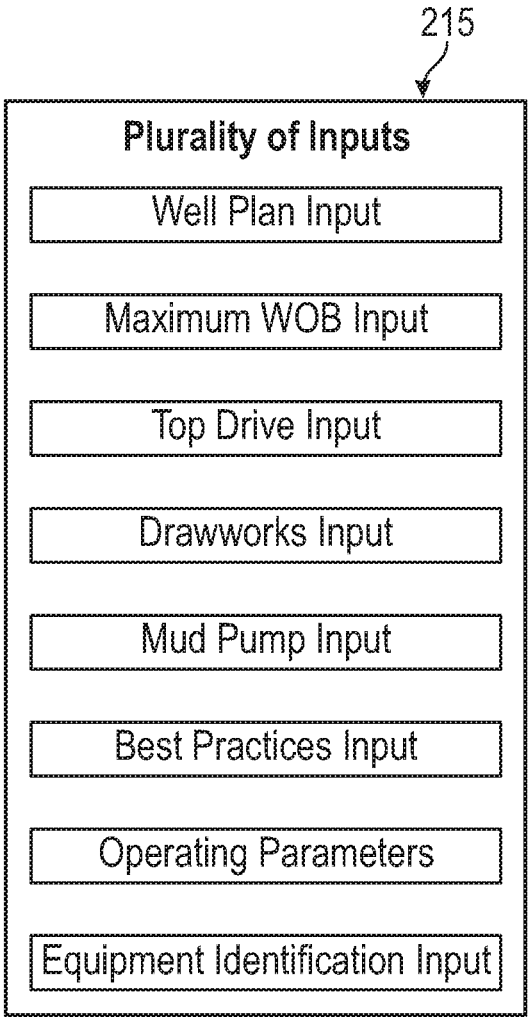
FIG. 3 is a listing of a plurality of inputs used by the drilling rig apparatus of FIG. 1, according to one or more aspects of the present disclosure.

FIG. 2 is a diagrammatic illustration of a data flow involving at least a portion of the apparatus 100 according to one embodiment. Generally, the controller 190 is operably coupled to or includes a GUI 195. The GUI 195 includes an input mechanism 200 for user-inputs or drilling parameters. The input mechanism 200 may include a touch-screen, keypad, voice-recognition apparatus, dial, button, switch, slide selector, toggle, joystick, mouse, data base and/or other conventional or future-developed data input device. Such input mechanism 200 may support data input from local and/or remote locations. Alternatively, or additionally, the input mechanism 200 may include means for user-selection of input parameters, such as predetermined toolface set point values or ranges, such as via one or more drop-down menus, input windows, etc. Drilling parameters may also or alternatively be selected by the controller 190 via the execution of one or more database look-up procedures. In general, the input mechanism 200 and/or other components within the scope of the present disclosure support operation and/or monitoring from stations on the rig site as well as one or more remote locations with a communications link to the system, network, local area network ("LAN"), wide area network ("WAN"), Internet, satellite-link, and/or radio, among other means. The GUI 195 may also include a display 205 for visually presenting information to the user in textual, graphic, or video form. The display 205 may also be utilized by the user to input the input parameters in conjunction with the input mechanism 200. For example, the input mechanism 200 may be integral to or otherwise communicably coupled with the display 205. The GUI 195 and the controller 190 may be discrete components that are interconnected via wired or wireless means. Alternatively, the GUI 195 and the controller 190 may be integral components of a single system or controller. The controller 190 is configured to receive electronic signals via wired or wireless transmission means (also not shown in FIG. 1) from a plurality of sensors 210 included in the apparatus 100, where each sensor is configured to detect an operational characteristic or parameter. The controller 190 also includes a drilling module 212 to control a drilling operation. The drilling module 212 may include a variety of sub modules, with each of the sub modules being associated with a predetermined workflow or recipe that executes a task from beginning to end. Often, the predetermined workflow includes a set of computer-implemented instructions for executing the task from beginning to end, with the task being one that includes a repeatable sequence of steps that take place to implement the task. The drilling module 212 generally implements the task of completing a steering operation, which steers the BHA 170 along the planned drilling path; recommends and executes the addition of another stand to the drill string 155; recommends and executes the process of tripping out the BHA 170; among other operations. The controller 190 is also configured to: receive a plurality of inputs 215 from a user via the input mechanism 200; and/or look up a plurality of inputs from a database. In some embodiments and as illustrated in FIG. 3, the plurality of inputs 215 includes the well plan input, a maximum WOB input, a top drive input, a draw works input, a mud pump input, best practices input, operating parameters, and equipment identification input, etc. In some embodiments, the plurality of operating parameters may include a maximum slide distance; a maximum dogleg severity; and a minimum radius of curvature. The plurality of operating parameters also includes orientation-tolerance window ("OTW") parameters, such as an inclination tolerance range and an azimuth tolerance range. The plurality of operating parameters also includes parameters that define an unwanted downhole trend, such as an equipment output trend parameters, geology trend parameters, and other downhole trend parameters. The plurality of operating parameters also includes location-tolerance window ("LTW") parameters, such as an offset direction, an offset distance, geometry, size, and dip angle. In some embodiments, the maximum slide distance may be zero. That is, no slides are recommended while the BHA 170 extends within a first formation type or during a specific period of time relative to the drilling process. The maximum slide distance is not limited to zero feet, but may be any number of feet or distance, such as for example 10 ft., 20 ft., 30 ft., 40, ft. 50 ft., 90 ft., etc. Generally, the maximum dogleg severity is the change in inclination over a distance and measures a build rate on a micro-level (e.g., 3°/100 ft.) while the minimum radius of curvature is associated with a build rate on a macro-level (e.g., 1°/1,000 ft.).

The orientation-tolerance window parameters include an inclination tolerance range and an azimuth tolerance range. In some embodiments, the inclination tolerance range and the azimuth tolerance range are associated with a location along the well plan and change depending upon the location along the well plan. That is, at some points along the well plan the inclination tolerance range and the azimuth tolerance range may be greater than the inclination tolerance range and the azimuth tolerance range along other points along the well plan.

Referring back to FIG. 2, the controller 190 is also operably coupled to a top drive control system 220, a mud pump control system 225, and a draw works control system 230, and is configured to send signals to each of the control systems 220, 225, and 230 to control the operation of the top drive 140, the mud pump 181, and the draw works 130. However, in other embodiments, the controller 190 includes each of the control systems 220, 225, and 230 and thus sends signals to each of the top drive 140, the mud pump 181, and the draw works 130.

In some embodiments, the top drive control system 220 includes the top drive 140, the speed sensor 140*b*, the torque sensor 140*a*, and the hook load sensor 140*c*. The top drive control system 220 is not required to include the top drive 140, but instead may include other drive systems, such as a power swivel, a rotary table, a coiled tubing unit, a downhole motor, and/or a conventional rotary rig, among others.

In some embodiments, the mud pump control system 225 includes a mud pump controller and/or other means for controlling the flow rate and/or pressure of the output of the mud pump 181.

In some embodiments, the draw works control system 230 includes the draw works controller and/or other means for controlling the feed-out and/or feed-in of the drilling line 125. Such control may include rotational control of the draw works (in v. out) to control the height or position of the hook 135 and may also include control of the rate the hook 135 ascends or descends. However, example embodiments within the scope of the present disclosure include those in which the draw works-drill-string-feed-off system may alternatively be a hydraulic ram or rack and pinion type hoisting system rig, where the movement of the drill string 155 up and down is via something other than the draw works 130. The drill string 155 may also take the form of coiled tubing, in which case the movement of the drill string 155 in and out of the hole is controlled by an injector head which grips and pushes/pulls the tubing in/out of the hole. Nonetheless, such embodiments may still include a version of the draw works controller, which may still be configured to control feed-out and/or feed-in of the drill string.

The plurality of sensors 210 may include the ROP sensor 130*a*; the torque sensor 140*a*; the quill speed sensor 140*b*; the hook load sensor 140*c*; the surface casing annular pressure sensor 187; the downhole annular pressure sensor 170*a*; the shock/vibration sensor 170*b*; the toolface sensor 170*c*; the MWD WOB sensor 170*d*; the mud motor delta pressure sensor; the bit torque sensor 172*b*; the hook position sensor; a rotary RPM sensor; a quill position sensor; a pump pressure sensor; a MSE sensor; a bit depth sensor; and any variation thereof. The data detected by any of the sensors in the plurality of sensors 210 may be sent via electronic signal to the controller 190 via wired or wireless transmission. The functions of the sensors 130*a*, 140*a*, 140*b*, 140*c*, 187, 170*a*, 170*b*, 170*c*, 170*d*, 172*a*, and 172*b* are discussed above and will not be repeated here.

Generally, the rotary RPM sensor is configured to detect the rotary RPM of the drill string 155. This may be measured at the top drive 140 or elsewhere, such as at surface portion of the drill string 155.

Generally, the quill position sensor is configured to detect a value or range of the rotational position of the quill 145, such as relative to true north or another stationary reference.

Generally, the pump pressure sensor is configured to detect the pressure of mud or fluid that powers the BHA 170 at the surface or near the surface.

Generally, the MSE sensor is configured to detect the MSE representing the amount of energy required per unit volume of drilled rock. In some embodiments, the MSE is not directly sensed, but is calculated based on sensed data at the controller 190 or other controller.

Generally, the bit depth sensor detects the depth of the bit 175.

In some embodiments the top drive control system 220 includes the torque sensor 140*a*, the quill position sensor, the hook load sensor 140*c*, the pump pressure sensor, the MSE sensor, and the rotary RPM sensor, and a controller and/or other means for controlling the rotational position, speed and direction of the quill or other drill string component coupled to the drive system (such as the quill 145 shown in FIG. 1). The top drive control system 220 is configured to receive a top drive control signal from the drilling module 212, if not also from other components of the apparatus 100. The top drive control signal directs the position (e.g., azimuth), spin direction, spin rate, and/or oscillation of the quill 145.

In some embodiments, the draw works control system 230 comprises the hook position sensor, the ROP sensor 130*a*, and the draw works controller and/or other means for controlling the length of drilling line 125 to be fed-out and/or fed-in and the speed at which the drilling line 125 is to be fed-out and/or fed-in.

In some embodiments, the mud pump control system 225 comprises the pump pressure sensor and the motor delta pressure sensor 172*a*.

In an example embodiment, the network 325 includes the Internet, one or more local area networks, one or more wide area networks, one or more cellular networks, one or more wireless networks, one or more voice networks, one or more data networks, one or more communication systems, and/or any combination thereof.

Figure 4:
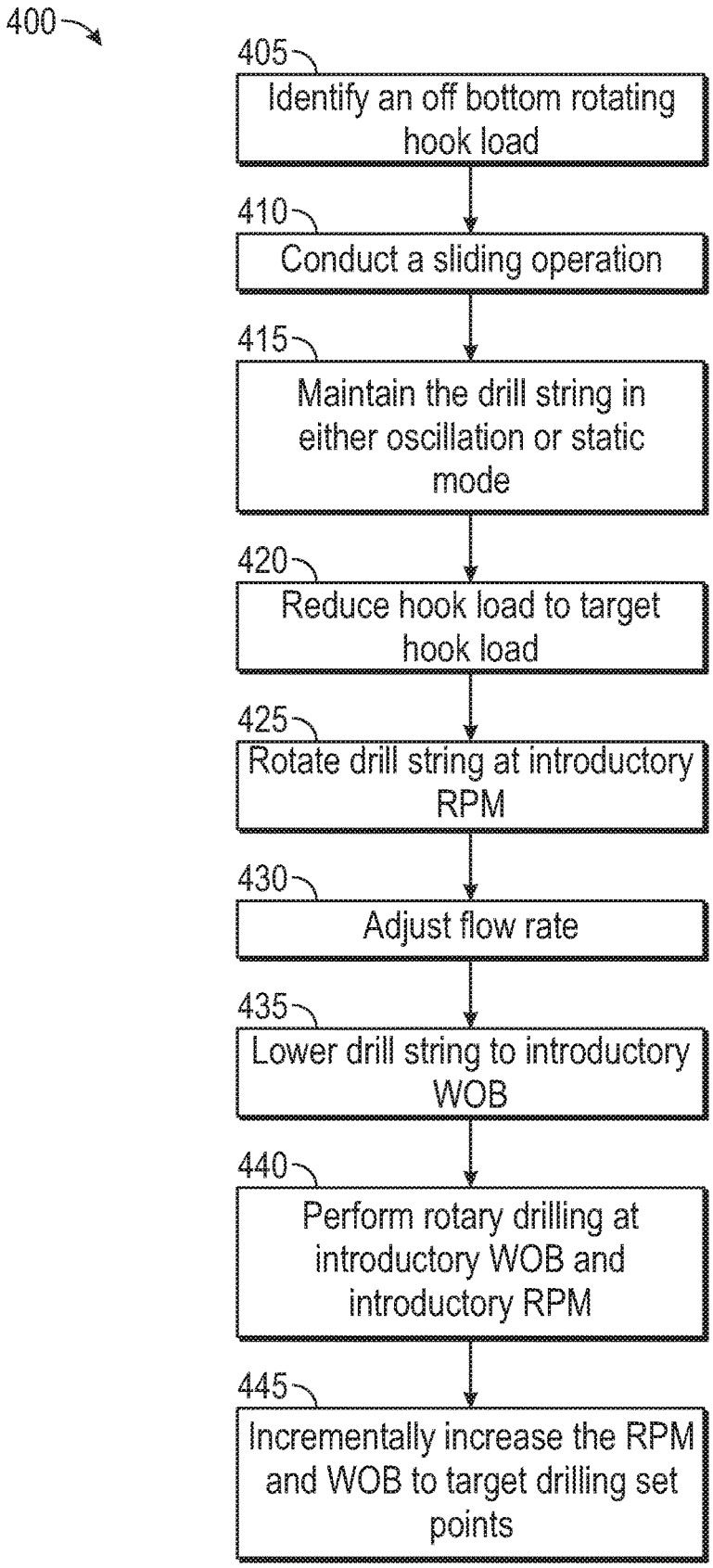
FIG. 4 is a flow-chart diagram of a method according to one or more aspects of the present disclosure.

In an example embodiment, as illustrated in FIG. 4 with continuing reference to FIGS. 1-3, a method 400 of operating the system 10 to transition from slide drilling to rotary drilling includes identifying an off-bottom rotating hook load at step 405; conducting a sliding operation at step 410; maintaining the drill string 155 in either oscillation or static mode at step 415; reducing hook load to target hook load at step 420; rotating drill string 155 at introductory RPM at step 425; adjusting flow rate at step 430; lowering the drill string 155 to an introductory WOB at step 435; performing rotary drilling at the introductory WOB and an introductory RPM at step 440; and incrementally increasing the RPM and WOB to target drilling set points at step 445.

In some embodiments and at step 405, an off-bottom rotating hook load is identified. Generally, the off-bottom rotating hook load is measured during the process of adding another stand to the drill string 155. The off-bottom rotating hook load is the load measured by the top drive 140 or other equipment at or near the surface of the well when the bit 175 is off-bottom and the drill string 155 is rotating. Generally, the hook load is the total force pulling down on the hook 135. This total force includes the weight of the drill string 155, the drill collars, and any ancillary equipment, reduced by any force that tends to reduce that weight. Some forces that might reduce the weight include friction along the wellbore wall (especially in deviated wells) and, importantly, buoyant forces on the drill string 155 caused by its immersion in drilling fluid. Regardless of how the off-bottom rotating hook load is captured or measured, it is accessed by the controller 190 and identified as the off-bottom rotating hook load. The bit 175 is off bottom during the step 405. In some embodiments, there is an indirect relation between WOB and hook load in that reducing the WOB increases the hook load and vice versa. As such, during the step 405 and when the off-bottom rotating hook load is identified, the WOB is generally zero and the hook load is close to a maximum because the bit 175 is not resting on the wellbore bottom.

In some embodiments and at step 410, sliding operations are conducted. In some embodiments, instructions or inputs for the sliding operations are manually input via an operator, but in other embodiments the instructions or inputs are provided by the system 10 or other program. Regardless, the sliding operations are performed. During the sliding operations, the drill string 155 may be oscillated or not oscillated (e.g., remain in static mode). The bit 175 is on bottom during the step 410. In some embodiments, the controller 190 and/or the drilling module 212 accesses the inputs and controls the sliding operation.

In some embodiments and at step 415, and after the sliding operations have been completed, the drill string 155 is maintained in either its oscillating state or not oscillating state. That is, when the drill string 155 was being oscillated during the sliding operations then the drill string 155 remains oscillated after the sliding operations, and when the drill string 155 was not in an oscillating state during the sliding operations then the drill string 155 remains in the not oscillated state after the sliding operations. The bit 175 is on the bottom during the step 415. In some embodiments, the controller 190 and/or the drilling module 212 controls the movement of the drill string 155 during the step 415.

In some embodiments and at step 420, the drill string 155 is lifted at a controlled speed until the hook load increases by a predetermined increase amount or to a predetermined reduced hook load. That is, the drill string 155 is lifted so that the hook load increases from the previously-captured off-bottom rotating hook load to a new hook load amount. In some embodiments, the controlled speed is between about 300-500 ft/hr., but other speeds are considered here. In some embodiments, the predetermined increase amount is about 10,000 lbs., so that the previously-captured off-bottom rotating hook load is reduced by 10,000 lbs. However, the predetermined increase amount is not limited to a predetermined hook load, but may also be presented or determined using a percentage of the previously-captured off-bottom rotating hook load. Generally, during the step 420, buckling and squat is removed or reduced from the drill string 155. In some embodiments, the controller 190 and/or the drilling module 212 controls the movement of the drill string 155 during the step 420.

In some embodiments and at step 425, the drill string 155 begins clockwise oscillation at a predetermined rotational speed, such as for example 5 RPM. However, the predetermined rotational speed can be a percentage of a target RPM or other amount. In some embodiments, the controller 190 and/or the drilling module 212 controls the movement of the drill string 155 during the step 425.

In some embodiments and at step 430, if the slide drilling flow rate is different than a rotary drilling flow rate, then the flow rate is incrementally transitioned towards, and eventually to, the rotary drilling rate. In some embodiments, the steps 425 and 430 occur simultaneously. In some embodiments, the controller 190 and/or the drilling module 212 controls the flow rate during the step 430.

In some embodiments and at step 435, the drill string 155 is lowered until an introductory WOB indicator setpoint is reached. In some embodiments, the introductory WOB indicator setpoint is a setpoint of one or more parameters that indicate the WOB or one or more parameters from which WOB can be inferred. For example, a ROP parameter, DP parameter, and a torque parameter can, together or individually, be used to infer the WOB. As such, each of a ROP parameter, a DP parameter, a torque parameter is a WOB indicator. In some embodiments, a WOB indicator setpoint is one or more of a setpoint for the ROP parameter, a setpoint for the DP parameter, and a setpoint for a torque parameter. In some embodiments, the WOB indicator is a WOB measurement and the WOB setpoint is a target WOB measurement. In some embodiments, the introductory WOB indicator setpoint is a setpoint that is lower or less than the full rotary drilling WOB setpoint or WOB indicator setpoint by a predetermined percentage. In some embodiments, the controller 190 and/or the drilling module 212 controls the movement of the drill string 155 during the step 435.

In some embodiments and at step 440, rotary drilling is performed at the introductory WOB and at an introductory RPM. The rotary drilling is performed for a predetermined period of time or predetermined distance, for example 2 feet, while the rotating top drive torque is monitored. In some embodiments, the controller 190 and/or the drilling module 212 controls the rotary drilling during the step 415.

In some embodiments and at step 445, after the predetermined period of time or predetermined distance, the WOB is increased to the full rotary drilling WOB and the RPM is incrementally increased, by such as for example 10 RPM increments, until a full target RPM for rotary drilling is reached. In some embodiments, the controller 190 and/or the drilling module 212 controls the rotary drilling during the step 415. In some embodiments and as noted above, the WOB is measured or inferred via one or more different measurements (e.g., ROP, DP, and torque).

In some embodiments, the bit 175 remains on bottom throughout any one or more of the steps 410, 415, 420, 425, 430, 435, 440, and 445. In some embodiments, the bit 175 is not lifted off bottom during the steps 410, 415, 420, 425, 430, 435, 440, and 445 and is not lifted off bottom during any transition between the steps 410, 415, 420, 425, 430, 435, 440, and 445. As such, the bit 175 is not lifted off the bottom when transitioning from slide drilling to rotary drilling.

Generally, lifting the bit 175 off bottom includes lifting the drill string 155 a sufficient distance to physically remove the bit 175 from a bottom of the wellbore 160. As such, the bit 175 remaining on the wellbore bottom involves the bit 175 physically touching the wellbore bottom. The WOB on the bit 175 may vary when the bit 175 is remaining on bottom.

Figure 5:
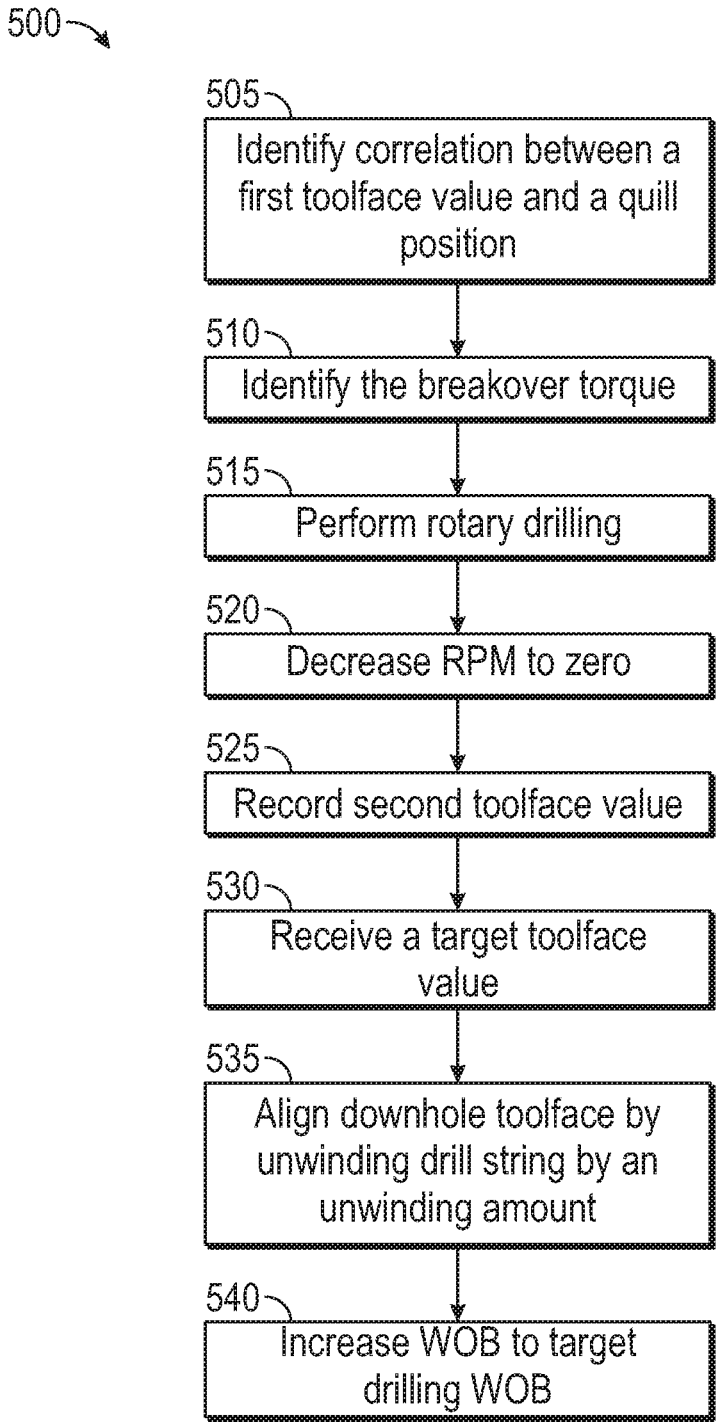
FIG. 5 is a flow-chart diagram of another method according to one or more aspects of the present disclosure.

In an example embodiment, as illustrated in FIG. 5 with continuing reference to FIGS. 1-4, a method 500 involves transitioning from rotary drilling to slide drilling without lifting the bit 175 off the wellbore bottom. In some embodiments, the method 500 includes identifying a correlation between a first toolface value and a quill position at step 505; identifying the breakover torque at step 510; performing rotary drilling at step 515; decreasing the RPM to zero at step 520; recording a second toolface value at step 525; receiving a target toolface value at step 530; aligning the downhole toolface by unwinding the drill string 155 by an unwind amount at step 535; and increasing WOB until the target drilling WOB is reached at step 540.

In some embodiments and at step 505, the system 10 identifies a correlation between the first toolface value, $TF_1$, and the quill position. Generally, this includes the system 10 capturing and storing the first toolface value $TF_1$ and a corresponding quill drive position when the drill string 155 is stationary. The first toolface value $TF_1$ is associated with the quill drive position and the quill position becomes a zero reference for the downhole toolface orientation. In some embodiments, the correlation is identified when the most recently added stand is added to the drill string 155. As such and in some embodiments, when a stand is added to the drill string 155, the first toolface value is captured. For example, during the step 505, the first toolface value, such as 90 degrees gravity toolface is captured, and the top drive quill position is zeroed in its corresponding position to define a $TD_0$ quill position. Generally, all of the tool face degree references are assumed to be 0°-360° (i.e., magnetic toolface). If gravity toolface values are considered (−180° to 180°), assume that a negative tool face value is converted to 0°-360° (i.e., −90° is equivalent to 270°).

In some embodiments and at step 510, the breakover torque is identified. Generally, the breakover torque is identified when the most recently added stand is added to the drill string 155. In some embodiments, the RPM of the drill string 155 is increased to a target drilling RPM. The rig control system 10 captures the torque measurement while the RPM is increased and records the number of revolutions required to reach a maximum off-bottom rotating torque, which is also referred to as "breakover torque." Breakover torque may be represented by the variable is $R_0$ and expressed in degrees (e.g., 1.5 revolutions=540°). During the step 510, the bit 175 is off the wellbore bottom. In some embodiments, the number of revolutions in either the clockwise or counterclockwise direction is measured relative to the zeroed top drive quill position ($TD_0$ quill position).

In some embodiments and at step 515, rotary drilling is performed. The bit 175 is on the bottom during the step 515.

Generally, during rotary drilling, there are WOB, flow, and RPM set points associated with rotary drilling.

In some embodiments and at step 520, at the conclusion of the rotary drilling interval, the RPM of the drill string 155 is reduced to zero while the WOB and flow are maintained at the previous rotary drilling set points.

In some embodiments and at step 525, after the RPM reaches zero, a second toolface value, $TF_2$, that is expressed in degrees is received and indicates the current orientation of the downhole motor. However, in some embodiments, the $TF_2$ is not received and instead, the $TF_1$ reference is used to compute/predict the current location of the downhole toolface orientation: the clockwise radial distance between $TD_0$ quill position and a current quill position. While the use of $TD_0$ quill position would be less accurate than using the $TF_2$, it is faster to execute compared to waiting on $TF_2$.

In some embodiments and at step 530, a target toolface value $TF_t$ is received by the system 10. In some embodiments, the target toolface $TF_t$ value is received from either a human input or an automated directional guidance system. This variable is $TF_t$ and is expressed in degrees.

In some embodiments and at step 535, the downhole toolface is aligned in the desired direction using an unwind amount. In some embodiments, the step 535 includes calculating a clockwise radial distance between $TF_2$ and $TF_t$, or $\Delta TF$. In some embodiments, and when $TF_t$ $TF_2$, then $\Delta TF$ is calculated as follows:

$$\Delta TF = TF_t - TF_2 \quad (1)$$

For example, when $TF_2$ is 270° and $TF_t$ is 360°, then $\Delta TF$ is 90°.

In some embodiments, and when $TF_2 > TF_t$, then $\Delta TF$ is calculated as follows:

$$\Delta TF = (360 - TF_2) + TF_t \quad (2)$$

For example, when $TF_2$ is 180° and $TF_t$ is 90°, then $\Delta TF$ is 270°. The step 535 also includes setting the surface RPM at 5 RPM counterclockwise to unwind the drill string 155 by an unwind amount calculated as $R_0 - \Delta TF$. Generally, this is the degrees of rotation for breakover torque when off bottom minus the change in toolface in the clockwise or counterclockwise direction. As a result, upon unwinding the drill string 155 by the unwind amount, the downhole toolface should be aligned in the desired direction. A toolface reading after the attempted alignment provides feedback regarding the accuracy of the predicted unwind amount. In addition to, or in place of, calculating the $\Delta TF$ in accordance with above, modeling may be used to refine or replace instructions to align the downhole toolface to $TF_t$. In some embodiments, historical data relating to the wellbore 160 being drilled, wellbores similar to but different from the wellbore 160, and/or one or more models may be used to generate the unwind amount. That is, in some embodiments, only observed values are inputs to determine the unwind amount but in other embodiments a variety of models and measurements (current and historical) are used to determine the unwind amount. In some embodiments and if the drill string 155 did not rotate counterclockwise enough based on the unwind amount, then the system 10 records the target unwind amount and the resulting toolface and changes future unwind amounts based on the previous insufficient counterclockwise rotation. In some embodiments, the system 10 forms a feedback control loop and the unwind amount is refined in accordance with the results monitored and stored by the system 10. In some embodiments, the system 10 considers the equipment within the BHA 170, drill string 155, and or rig and resulting toolface movements.

In some embodiments and when the unwind amount is calculated using historical measurements, the historical measurements are weighted based on recentness of the historical measurement. That is, a historical measurement associated with the most recent slide is weighted heavier than a historical measurement associated with a fifth most recent slide.

In some embodiments and at step 540, the WOB is increased to a target drilling WOB is reached and oscillation of the drill string 155 is initiated per drilling parameters. Generally, drilling proceeds with adjustments to the top drive quill position to conduct slide drilling with the toolface oriented correctly.

The method 500 may be altered in a variety of ways. For example, instead of the unwind amount being calculated and having a unit of degrees or wraps (i.e., 360° in one direction), the unwind amount may be calculated based on torque transferred to the drill string 155 at the surface of the well. For example, the torque could be measured between a free section of pipe and the top drive 140, with the torque being applied correlating to a downhole toolface direction.

In some embodiments, the bit 175 may be physically touching the wellbore bottom yet the system 10 may indicate or show that the bit 175 is off bottom because the system 10 may not calculate or consider compression of the drill string 155.

With conventional systems, the transition between rotary and slide drilling involves the removal of the bit from the bottom of the well. Generally, the highest levels of shock and vibration, which are phenomena that cause damage to bit cutters and downhole equipment, occur while placing the bit on bottom or removing the bit from bottom. In addition to the high levels of shock and vibration, the process of transitioning between rotary and slide drilling can be time consuming. The system 10 uses rig automation to accomplish the transition between rotary and slide drilling, and vice versa, without removing the bit 175 from bottom, which has the effect of minimizing downhole shock and vibrations, reducing downhole equipment failures, and reducing nonproductive time at the rig.

Methods within the scope of the present disclosure may be local or remote in nature. These methods, and any controllers discussed herein, may be achieved by one or more intelligent adaptive controllers, programmable logic controllers, artificial neural networks, and/or other adaptive and/or "learning" controllers or processing apparatus. For example, such methods may be deployed or performed via PLC, PAC, PC, one or more servers, desktops, handhelds, and/or any other form or type of computing device with appropriate capability.

The term "about," as used herein, should generally be understood to refer to both numbers in a range of numerals. For example, "about 1 to 2" should be understood as "about 1 to about 2." Moreover, all numerical ranges herein should be understood to include each whole integer, or 1/10 of an integer, within the range.

Figure 6:
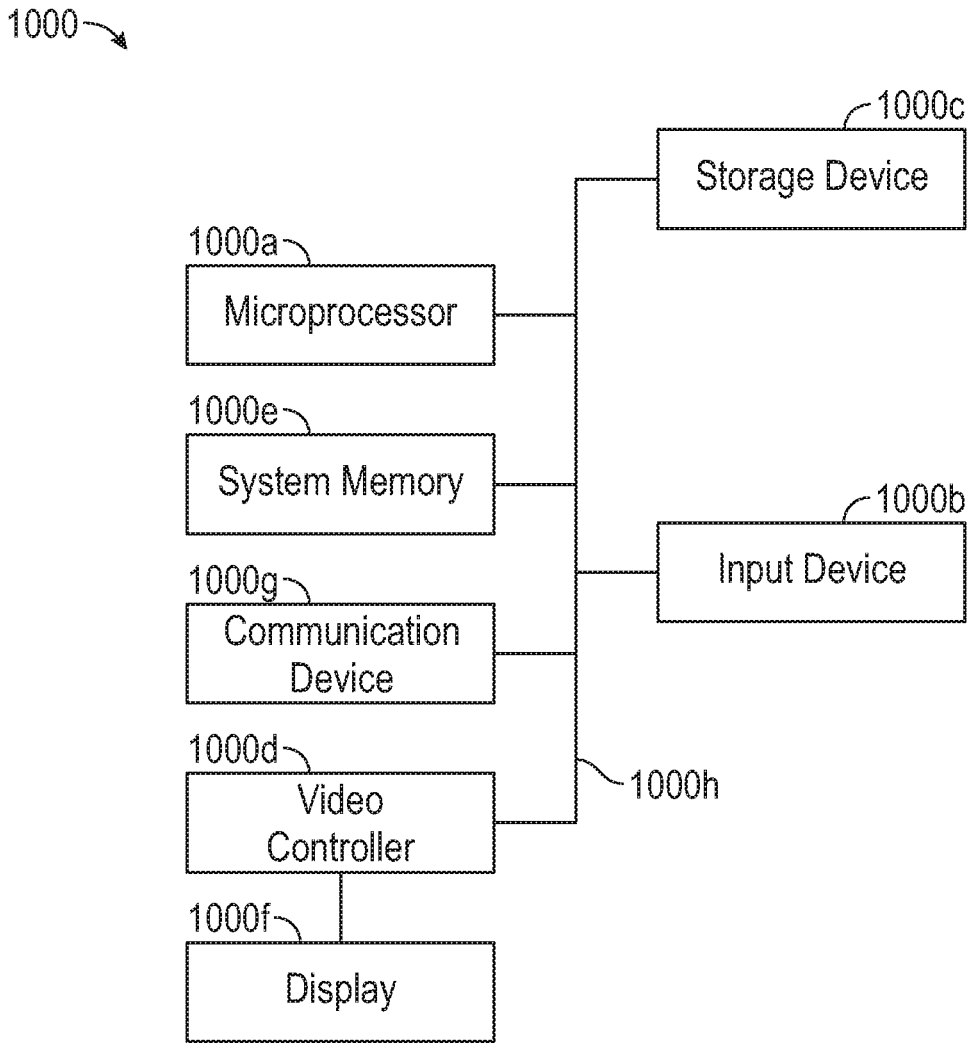
FIG. 6 is a diagrammatic illustration of a node for implementing one or more example embodiments of the present disclosure, according to an example embodiment.

In an example embodiment, as illustrated in FIG. 6 with continuing reference to FIGS. 1-5, an illustrative node 1000 for implementing one or more embodiments of one or more of the above-described networks, elements, methods and/or steps, and/or any combination thereof, is depicted. The node 1000 includes a microprocessor 1000*a*, an input device 1000*b*, a storage device 1000*c*, a video controller 1000*d*, a system memory 1000*e*, a display 1000*f*, and a communication device 1000*g*, all interconnected by one or more buses 1000*h*. In several example embodiments, the storage device 1000*c* may include a floppy drive, hard drive, CD-ROM, optical drive, any other form of storage device and/or any combination thereof. In several example embodiments, the storage device 1000*c* may include, and/or be capable of receiving, a floppy disk, CD-ROM, DVD-ROM, or any other form of computer-readable non-transitory medium that may contain executable instructions. In several example embodiments, the communication device 1000*g* may include a modem, network card, or any other device to enable the node to communicate with other nodes. In several example embodiments, any node represents a plurality of interconnected (whether by intranet or Internet) computer systems, including without limitation, personal computers, mainframes, PDAs, and cell phones.

In several example embodiments, one or more of the controllers 180, 190 the GUI 195, and any of the sensors, includes the node 1000 and/or components thereof, and/or one or more nodes that are substantially similar to the node 1000 and/or components thereof.

In several example embodiments, software includes any machine code stored in any memory medium, such as RAM or ROM, and machine code stored on other devices (such as floppy disks, flash memory, or a CD ROM, for example). In several example embodiments, software may include source or object code. In several example embodiments, software encompasses any set of instructions capable of being executed on a node such as, for example, on a client machine or server.

In several example embodiments, a database may be any standard or proprietary database software, such as Oracle, Microsoft Access, SyBase, or DBase II, for example. In several example embodiments, the database may have fields, records, data, and other database elements that may be associated through database specific software. In several example embodiments, data may be mapped. In several example embodiments, mapping is the process of associating one data entry with another data entry. In an example embodiment, the data contained in the location of a character file can be mapped to a field in a second table. In several example embodiments, the physical location of the database is not limiting, and the database may be distributed. In an example embodiment, the database may exist remotely from the server, and run on a separate platform. In an example embodiment, the database may be accessible across the Internet. In several example embodiments, more than one database may be implemented.

In several example embodiments, while different steps, processes, and procedures are described as appearing as distinct acts, one or more of the steps, one or more of the processes, and/or one or more of the procedures could also be performed in different orders, simultaneously and/or sequentially. In several example embodiments, the steps, processes and/or procedures could be merged into one or more steps, processes and/or procedures.

It is understood that variations may be made in the foregoing without departing from the scope of the disclosure. Furthermore, the elements and teachings of the various illustrative example embodiments may be combined in whole or in part in some or all of the illustrative example embodiments. In addition, one or more of the elements and teachings of the various illustrative example embodiments may be omitted, at least in part, and/or combined, at least in part, with one or more of the other elements and teachings of the various illustrative embodiments.

Any spatial references such as, for example, "upper," "lower," "above," "below," "between," "vertical," "horizontal," "angular," "upwards," "downwards," "side-to-side," "left-to-right," "right-to-left," "top-to-bottom," "bottom-to-top," "top," "bottom," "bottom-up," "top-down," "front-to-back," etc., are for the purpose of illustration only and do not limit the specific orientation or location of the structure described above.

In several example embodiments, one or more of the operational steps in each embodiment may be omitted or rearranged. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several example embodiments have been described in detail above, the embodiments described are example only and are not limiting, and those of ordinary skill in the art will readily appreciate that many other modifications, changes and/or substitutions are possible in the example embodiments without materially departing from the novel teachings and advantages of the present disclosure. Accordingly, all such modifications, changes and/or substitutions are intended to be included within the scope of this disclosure as defined in the following claims. In the claims, means-plus-function clauses are intended to cover the structures described herein as performing the recited function and not only structural equivalents, but also equivalent structures.

What is claimed is:

1. A method of transitioning from rotary drilling to slide drilling while maintaining a bit of a bottom hole assembly on a wellbore bottom, wherein the method comprises:

(a) recording a first measured toolface value of the bottom hole assembly, wherein the bottom hole assembly is coupled to a drill string;

(b) identifying a correlation between the first measured toolface value and a first quill position of a quill coupled to the drill string;

(c) identifying a breakover torque for the drill string;

(d) performing rotary drilling;

(e) recording a second measured toolface value while the bit remains on the wellbore bottom;

(f) receiving, while the bit remains on the wellbore bottom, a target toolface value;

(g) calculating, while the bit remains on the wellbore bottom, an unwind amount to unwind the drill string; and (h) unwinding the drill string by the unwind amount to bring the second measured toolface value closer to the target toolface value while the bit remains on the wellbore bottom, wherein each of the second measured toolface value, the unwind amount, and the target toolface value is expressed in degrees;

wherein calculating the unwind amount comprises:

calculating a clockwise radial distance expressed in degrees between the second measured toolface value and the target toolface value; and subtracting the clockwise radial distance from the breakover torque to determine the unwind amount.

2. The method of claim 1, wherein when the second measured toolface value is greater than the target toolface value, then the clockwise radial distance is a difference—of 360 degrees and the second measured toolface value—added to the target toolface value.

3. The method of claim 1, wherein when the target toolface value is greater than the second measured toolface value, then the clockwise radial distance is the difference between the target toolface value and the second measured toolface value.

4. The method of claim 1, which further comprises:

increasing a weight on bit ("WOB") after unwinding the drill string;

oscillating the drill string; and beginning slide drilling.

5. The method of claim 4, wherein the following steps (a)-(c) occur during an operation to add a stand of pipe to the drill string, and wherein the operation to add the stand of pipe occurs prior to the beginning of the slide drilling.

6. The method of claim 1, wherein the drill string is not rotating when the first measured toolface value is recorded; and wherein identifying the correlation between the first measured toolface value and the first quill position comprises referencing rotation of the drill string relative to the first quill position.

7. The method of claim 1, wherein identifying the breakover torque for the drill string comprises:

capturing a torque measurement while increasing a rotations per minute ("RPM") of the drill string; and recording a number of revolutions required to reach maximum off-bottom rotating torque as the breakover torque.

8. The method of claim 1, wherein performing rotary drilling comprises rotary drilling at a WOB indicator setpoint and a flow rate setpoint; and wherein the method further comprises, after performing rotary drilling and before the second measured toolface value is recorded, reducing an RPM of the drill string to zero while maintaining the WOB indicator at the WOB indicator setpoint and the flow rate at the flow rate setpoint.

9. An apparatus adapted to transition a bit of a bottom hole assembly from a rotary drilling operation to a slide drilling operation while maintaining the bit on a wellbore bottom, the apparatus comprising:

a non-transitory computer readable medium having stored thereon a plurality of instructions, wherein the instructions are executed with at least one processor so that the following steps are executed:

(a) recording a first measured toolface value of the bottom hole assembly, wherein the bottom hole assembly is coupled to a drill string;

(b) identifying a correlation between the first measured toolface value and a first quill position of a quill coupled to the drill string;

(c) identifying a breakover torque for the drill string;

(d) performing rotary drilling;

(e) recording a second measured toolface value while the bit remains on the wellbore bottom;

(f) receiving, while the bit remains on the wellbore bottom, a target toolface value;

(g) calculating, while the bit remains on the wellbore bottom, an unwind amount to unwind the drill string; and (h) unwinding the drill string by the unwind amount to bring the second measured toolface value closer to the target toolface value while the bit remains on the wellbore bottom, wherein the instructions are executed with the at least one processor so that the following additional steps are executed:

increasing a weight on bit ("WOB") after unwinding the drill string; and beginning slide drilling.

10. The apparatus of claim 9, wherein each of the second measured toolface value, the unwind amount, and the target toolface value is expressed in degrees;

wherein calculating the unwind amount comprises:

calculating a clockwise radial distance expressed in degrees between the second measured toolface value and the target toolface value; and subtracting the clockwise radial distance from the breakover torque to determine the unwind amount.

11. The apparatus of claim 10, wherein when the second measured toolface value is greater than the target toolface value, then the clockwise radial distance is a difference—of 360 degrees and the second measured toolface value—added to the target toolface value.

12. The apparatus of claim 10, wherein when the target toolface value is greater than the second measured toolface value, then the clockwise radial distance is the difference between the target toolface value and the second measured toolface value.

* * * * *